US010052898B1

(12) United States Patent
Williams et al.

(10) Patent No.: US 10,052,898 B1
(45) Date of Patent: Aug. 21, 2018

(54) DOCKING DEVICE WITH LOCATING PIN AND RECEPTACLE FOR DOCKABLE MEMBERS IN A PRINTER

(71) Applicant: Xerox Corporation, Norwalk, CT (US)

(72) Inventors: Stephen B. Williams, Marion, NY (US); Joseph M. Ferrara, Jr., Webster, NY (US); Annie Liu, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 15/611,211

(22) Filed: Jun. 1, 2017

(51) Int. Cl.
*B41J 2/235* (2006.01)
*B41J 29/56* (2006.01)
*E05B 73/00* (2006.01)

(52) U.S. Cl.
CPC ..... *B41J 29/56* (2013.01); *E05B 73/0082* (2013.01)

(58) Field of Classification Search
CPC ..... B41J 2/235; B41J 29/56
See application file for complete search history.

(56) References Cited

U.S. PATENT DOCUMENTS 4,532,713 A 8/1985 Feichtinger
4,872,026 A 10/1989 Rasmussen et al.
5,812,157 A 9/1998 Nguyen et al.
6,213,580 B1 4/2001 Segerstrom et al.
6,322,204 B1 11/2001 Blum et al.
6,341,915 B1 1/2002 Kammel
6,755,131 B2 6/2004 Dannoux et al.
6,937,260 B2 8/2005 Williams et al.
8,038,240 B2 10/2011 Tsai
2007/0246698 A1 10/2007 Truckner et al.
2010/0236047 A1* 9/2010 Tsai ..... B41J 25/308 29/464
2013/0276300 A1* 10/2013 Cha ..... B23P 19/04 29/700

OTHER PUBLICATIONS

Prior art locating pin drawings (available prior to Jun. 1, 2017) See: http://blog.misumiusa.com/the-lowdown-on-locating-pins/.

* cited by examiner

*Primary Examiner* — Jason Uhlenhake
(74) *Attorney, Agent, or Firm* — Maginot Moore & Beck LLP

(57) ABSTRACT

A locating pin that is configured to be connected to a dockable member in a printer includes a shaft, first and second ends, and a conical member. The first end has a surface forming a partial ellipsoid and the conical member has a base aligned with the surface of the first end and a tip extending from the surface of the first end. The shaft is configured to engage the dockable member along a portion of the shaft between the second end and the first end.

22 Claims, 7 Drawing Sheets

DOCKING DEVICE WITH LOCATING PIN AND RECEPTACLE FOR DOCKABLE MEMBERS IN A PRINTER

TECHNICAL FIELD

This disclosure is directed to inkjet printers that include one or more printheads and, more particularly, to docking devices for dockable members in printers.

BACKGROUND

Some inkjet printers employ arrays of printheads that are mounted to print bars in a print zone. Each print bar is a rigid, elongated member that is, for example, formed from steel or another metallic structure with attachment points for one or more printheads. In one printer configuration that is known to the art, a single printhead array is formed using seven printheads that are affixed to predetermined locations on two different print bars (three printheads on a first bar and four printheads on a second bar) in a staggered configuration to enable the printheads to cover the width of the print zone. Alternative configurations use different numbers of print bars and printheads. Some inkjet printers include multiple sets of these printhead arrays to form color printed images using different printhead arrays for each color or to increase the effective resolution of the printer by interleaving lower resolution printheads in two or more printhead arrays to form printed images with a higher effective resolution.

During a printing operation the print bars should hold the printheads in fixed positions within a print zone at precise positions and orientations relative to a print medium or other image receiving member to ensure that the printheads are properly aligned to form printed images. Even comparatively small errors in the position or orientation of the printheads on the print bar may result in an easily noticeable degradation in the quality of printed images. However, while print bars remain in a fixed position during a printing operation, during printhead maintenance and other operations, a member in the print zone that carries a print medium or other image receiving surface moves away from the print bars to enable a printhead maintenance unit to clean the printheads and to provide access for printhead repair or replacement. When the unit of the printer that carries the print medium or other image receiving surface returns to engage the print bars, one or more docking pins in the unit engage a fixed bushing that is formed on at least one side of the print bar to return the components in the printer to a precise location relative to one another for additional printing in an operation that is referred to as "docking."

Existing docking devices have drawbacks because they must both include sufficient mechanical tolerances to enable docking but also ensure that, in the docked configuration, the print bar and the unit in the printer remain at a precise position and angular orientation to ensure that the printheads on the print bar are properly aligned in the print zone to form printed images. FIG. 7 depicts challenges with a prior art locating pin 700 with a shaft 706 that is connected to a portion of a unit in the printer (not shown), such as a media control path or an indirect image receiving member that receive printed ink images from the printheads on the print bar, and an end 704 that should engage a bushing 720 that is affixed to one end of a print bar. In view 750, the end of the pin 704 is misaligned with the bushing 720 and effectively fails to engage the bushing 720. In view 760, even if the locating pin 700 engages the bushing 720, in some instances the shaft 706 deviates from a predetermined orientation (deviation from vertical in the example of FIG. 7). Even if the locating pin 700 engages the bushing 720, the print bar may still have an incorrect orientation relative to the image receiving surface that negatively impacts the quality of printed documents in the printer. Consequently, improvements to docking devices in inkjet printers that reduce or eliminate these drawbacks in prior art devices would be beneficial.

SUMMARY

In one embodiment, a locating pin for a dockable member in an inkjet printer has been developed. The locating pin includes a shaft including a first end having a surface forming a partial ellipsoid and a second end, the shaft being configured to engage the dockable member along a portion of the shaft between the second end and the first end, and a conical member with a base aligned with the surface of the first end and a tip extending from the surface of the first end.

In another embodiment, a docking device for a dockable member in an inkjet printer has been developed. The docking device includes a locating pin, the locating pin and a receptacle configured to be configured to be integrated with a second dockable member. The locating pin includes a shaft including a first end having a surface forming a partial ellipsoid and a second end, the shaft being configured to engage a first dockable member along a portion of the shaft between the second end and the first end and a conical member with a base aligned with the surface of the first end and a tip extending from the surface of the first end. The receptacle includes a housing having a first cavity formed at least partially from a first wall in the housing and including a first opening, the first cavity being configured to receive the first end and the conical member of the locating pin, and a second cavity formed at least partially from a second wall in the housing, the second cavity including a second opening in communication with the first cavity, the second opening being narrower than the first opening, the second cavity being configured to receive the conical member of the locating pin.

BRIEF DESCRIPTION OF THE DRAWINGS

The foregoing aspects and other features of locating pins and docking devices in inkjet printers are explained in the following description, taken in connection with the accompanying drawings.

DETAILED DESCRIPTION

Figure 1:
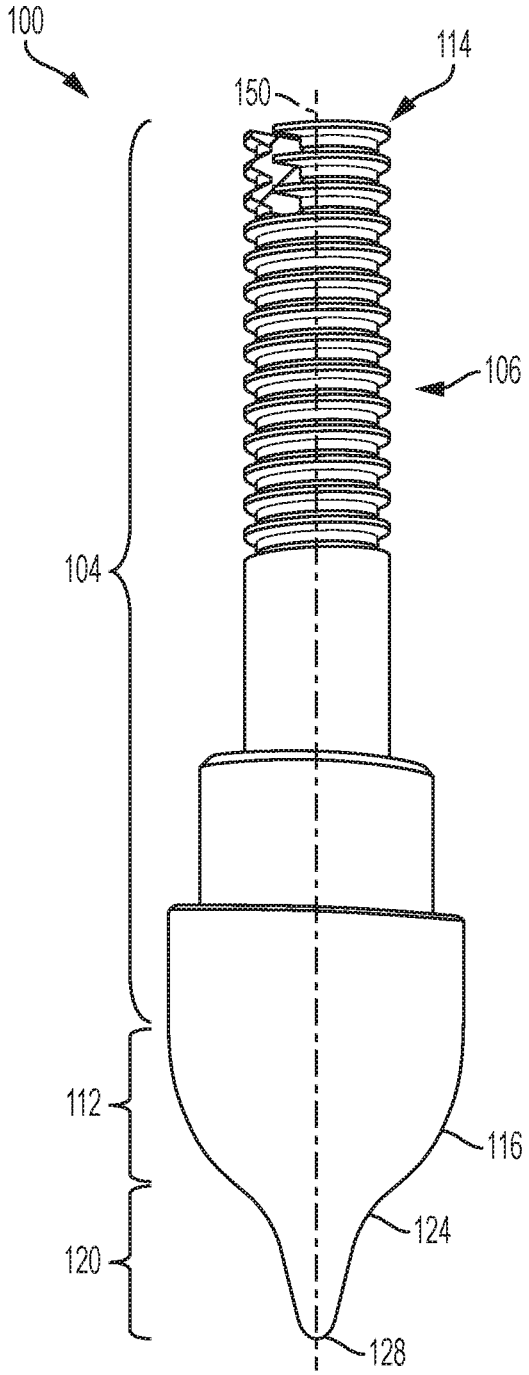
FIG. 1 is a side view depiction of a locating pin.

For a general understanding of the environment for the device disclosed herein as well as the details for the device, reference is made to the drawings. In the drawings, like reference numerals designate like elements.

As used herein, the term "dockable member" refers to a structure in a printer that is configured to engage and disengage another structure in the printer using a docking device. Both of the structures that engage and disengage each other are referred to as dockable members. During operation of the printer, one or both of the dockable members move in and out of the docked positions, and the docking devices described herein enable the dockable members to move into and out of the docking configuration reliably and with high precision to, for example, ensure proper position and alignment of printheads that are supported by a print bar in a print zone.

The docking devices described herein include a locating pin and a receptacle that receives the locating pin. Each dockable member described herein incorporates either the locating pin or the receptacle that engages a corresponding receptacle or locating pin, respectively, in another dockable member. Two examples of dockable members in a printer include a print bar and a housing structure in the printer that contains components that are aligned with the printheads on the print bar. The print bar, as described above, supports one or more printheads. The housing structure is, for example, a structure in the printer that contains a print media unit that further includes a transport device for print media, such as paper, or an indirect image receiving member such as a drum or endless belt. Another embodiment of a housing structure is a printhead maintenance unit that cleans the printheads on the print bar during a maintenance operation. In the embodiments described herein, the housing structure engages and disengages from the print bar during different operating modes within a printer. The docking devices described herein enable the print bar and housing structure dockable members to dock with high reliability and high precision during operation of the printer.

As used herein, the term "partial ellipsoid" refers to a shape of a surface formed at one end of a locating pin that conforms, at least substantially, to a portion of a geometric ellipsoid of the form $$\frac{x^2}{a^2} + \frac{y^2}{b^2} + \frac{z^2}{c^2} = 1$$

for Cartesian coordinates x, y, and z with axes having lengths a, b, and c. More specific examples of ellipsoids include spheroids in which two of the axes a, b, and c have equal lengths and, if all three axes have equal lengths, the spheroid is also a sphere. In the structure of a locating pin, a portion of the surface of one end is formed with a shape that corresponds to a portion of an ellipsoid. However, since the end of the locating pin is attached to a shaft and to a conical member as is described below, the surface does not have the shape of the entire ellipsoid, and is therefore described as a "partial ellipsoid" herein.

FIG. 1 depicts a locating pin 100. The locating pin 100 includes a shaft 104, a first end 112, a second end 114, and a conical member 120. The shaft 104 is, for example, formed from one or more elongated cylindrical members that extend between the first end 112 and the second end 114. The shaft 104 is configured to engage a dockable member in the printer along a portion of the shaft between the second end 114 and the first end 112. In the embodiment of FIG. 1, the shaft 104 further includes thread 106 that is formed along the portion of the shaft 104. As used herein, the term "thread" refers to a helical structure that is formed around an exterior of the shaft 104 or another cylindrical member that enables the locating pin 100 to engage another thread formed in a socket in a dockable member to attach the locating pin 100 to the dockable member. Thread structures are generally known to the art for use in bolts and similar fasteners and are not described in greater detail herein. The thread 106 extends from the second end 114 along a portion of the shaft 104 to enable the shaft 104 to engage a socket in the dockable member, which connects the locating pin 100 to the dockable member.

The first end 112 of the locating pin 100 has a surface 116 that forms a partial ellipsoid. The surface 116 includes the curved shape of the partial ellipsoid to enable the locating pin 100 to engage a receptacle to enable a dockable member that is connected to the shaft 104 of the locating pin 100 to dock with a corresponding receptacle in a print bar or other dockable member in the printer.

The conical member 120 includes a base 124 that is aligned with the surface of the first end 112 and a tip 128 that extends from the surface of the first end 112. In the embodiment of FIG. 1, the base 124 forms a flared shape that conforms to the partial ellipsoid surface 116 of the first end 112 to provide a continuously curved surface from the surface 116 of the first end 112 to the tip 128 of the conical member 120. The conical member 120 and the shaft 104 are oriented along a single longitudinal axis 150 that extends through the length of the locating pin 100. As described in further detail below, the conical member 120 enables the locating pin 100 to engage a housing of a receptacle during a docking operation and to ensure that the locating pin 100 engages the receptacle at a predetermined angular orientation to ensure that the print bar is in a proper location and orientation with a housing structure in the printer when docked.

In the illustrative embodiment of FIG. 1, the locating pin 100 is formed from a monolithic member, such as a single piece of stainless steel, another suitable metal, such as aluminum, or a metallic alloy. One or more manufacturing processes that are known to the art such as milling, forging, and die casting form the locating pin 100 from the monolithic member with the various features of the shaft 104, first end 112, and conical member 120 that are described above. While the locating pin 100 is substantially formed from stainless steel or another metallic compound, in some embodiments the first end 112, conical member 120, and optionally other portions of the locating pin 100 are coated with a low-energy material such as Polytetrafluoroethylene (PTFE), or are coated with rubber.

Figure 5:
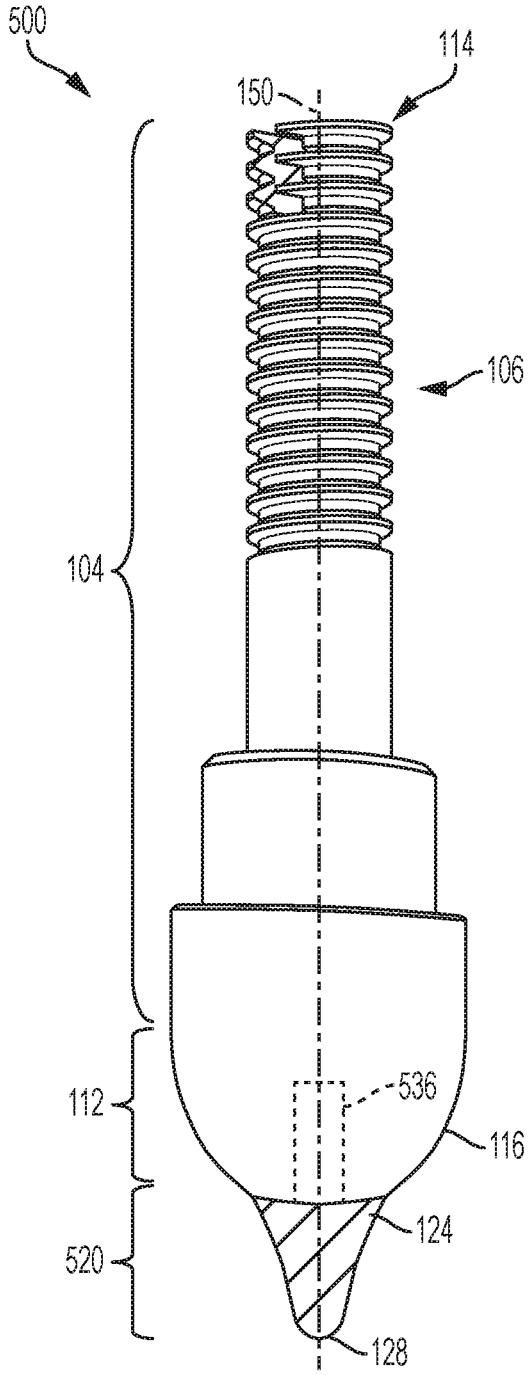
FIG. 5 is a side view depiction of another embodiment of the locating pin of FIG. 1.

FIG. 5 depicts another embodiment of a locating pin 500. The locating pin 500 also includes the shaft 100, first end 112, second end 114, and a conical member 520. In the embodiment of the locating pin 500, the conical member 520 is formed from a separate member than the shaft 104 and first end 112. The conical member 520 is affixed to the first end 112 via a connection socket 536 that engages the separate conical member 520 with a thread or a friction-fit connection, which enables selective coupling for replacement of the conical member 520 without requiring replacement of the rest of the locating pin 500. The conical member 520 also includes a base 124 and tip 128 with the same or similar shapes as the conical member 120 in the locating pin 100. In one embodiment, the separate conical member 520 is formed from a steel or other metallic member that is configured to be connected and disconnected from the first member forming the shaft 104 and the first end 112 via the connection socket 536. The exterior of the conical member 520 is coated partially or completely with a rubber material that extends from the partial ellipsoid surface 116 of the first end 112 of the locating pin 500, while the shaft 104 and the first end 112 are formed from stainless steel or another metallic material. Locating pins 100 and 500 can be used interchangeably with all of the docking device embodiments that are described herein.

Figure 2:
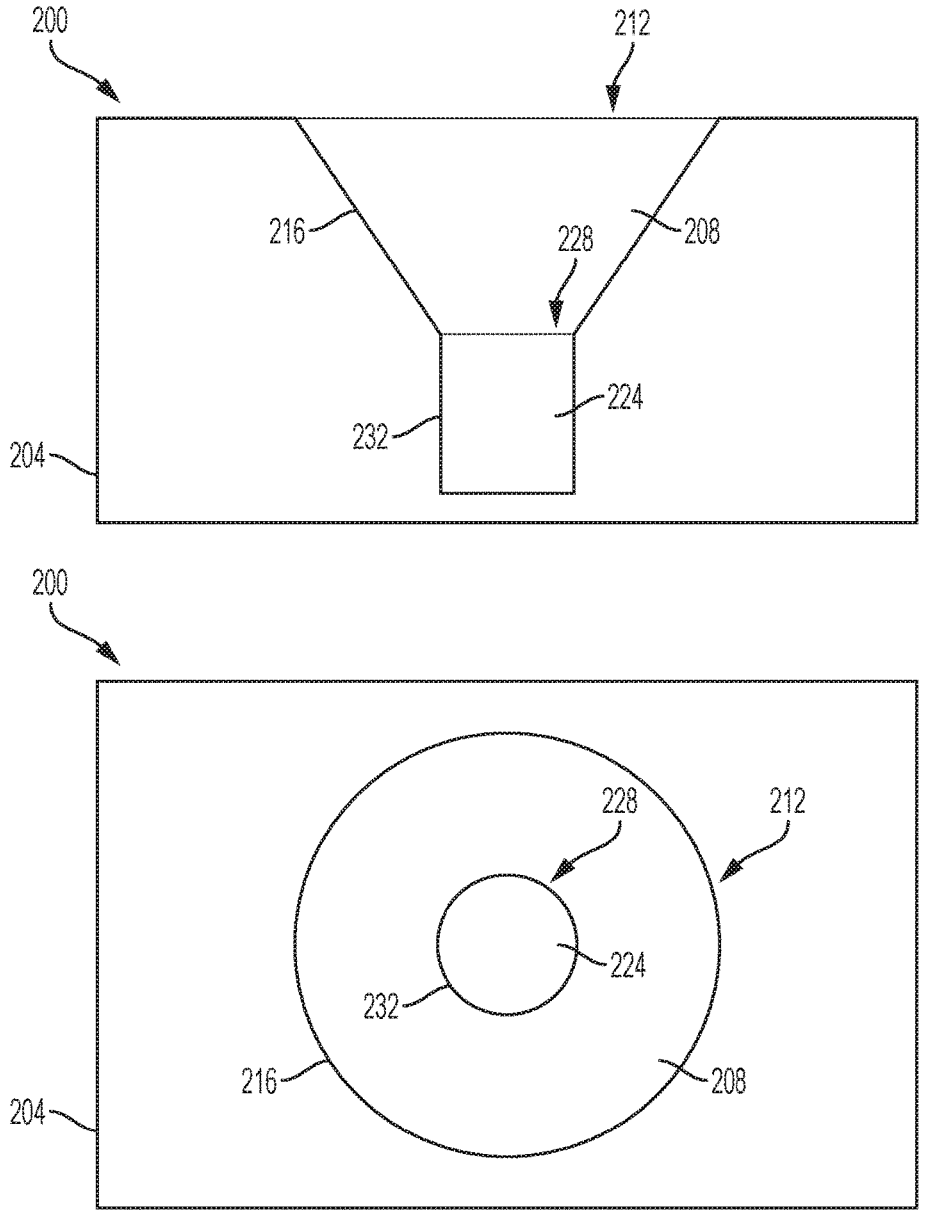
FIG. 2 is a cut-away view and plan view of a receptacle that receives a locating pin.

A docking device for a print bar or other dockable member in a printer includes both a locating pin, such as the locating pins 100 and 500, and a receptacle that receives the locating pins to hold the print bar at a predetermined location. FIG. 2 depicts one embodiment of a receptacle 200 with a cut-away side view and plan view of the same receptacle 200. The receptacle 200 is formed from a housing 204 that includes a first cavity 208 and a second cavity 224. The first cavity 208 includes a first opening 212 through the housing 204 that enables the first cavity 208 to receive both the conical member and the first end of a locating pin. The second cavity 224 includes a second opening 228 that is in communication with the first cavity 208. The second opening 228 is narrower than the first opening 212 and the second cavity 224 is configured to receive the conical member of the locating pin while all or a substantial portion of the first end of the locating pin remains within the first cavity 208. In the illustrative example of FIG. 2, the first opening 212 and the second opening 232 are both formed with a circular shape, although alternative embodiments of the receptacle include openings with different shapes that can receive a locating pin.

In the receptacle 200, the first cavity 208 is formed, at least partially, from a first wall 216, which is formed with a conical shape as shown in the illustrative embodiment of FIG. 2. The second cavity 224 is formed, at least partially, from a second wall 232. In the embodiment of FIG. 2, the first wall 216 is formed with a tapered shape extending from the wider first opening 212 to the narrower second opening 228 where the first wall 216 meets the second wall 232. In one embodiment of the receptacle 200, the first wall 216 and the second wall 232 of the housing 204 are formed from stainless steel or another metallic material. In one embodiment, the material of the housing 204 forms the walls 216 and 232 directly, while in another embodiment the housing 204 is formed from a separate member and the walls 216 and 232 are affixed to the housing 204.

Figure 3:
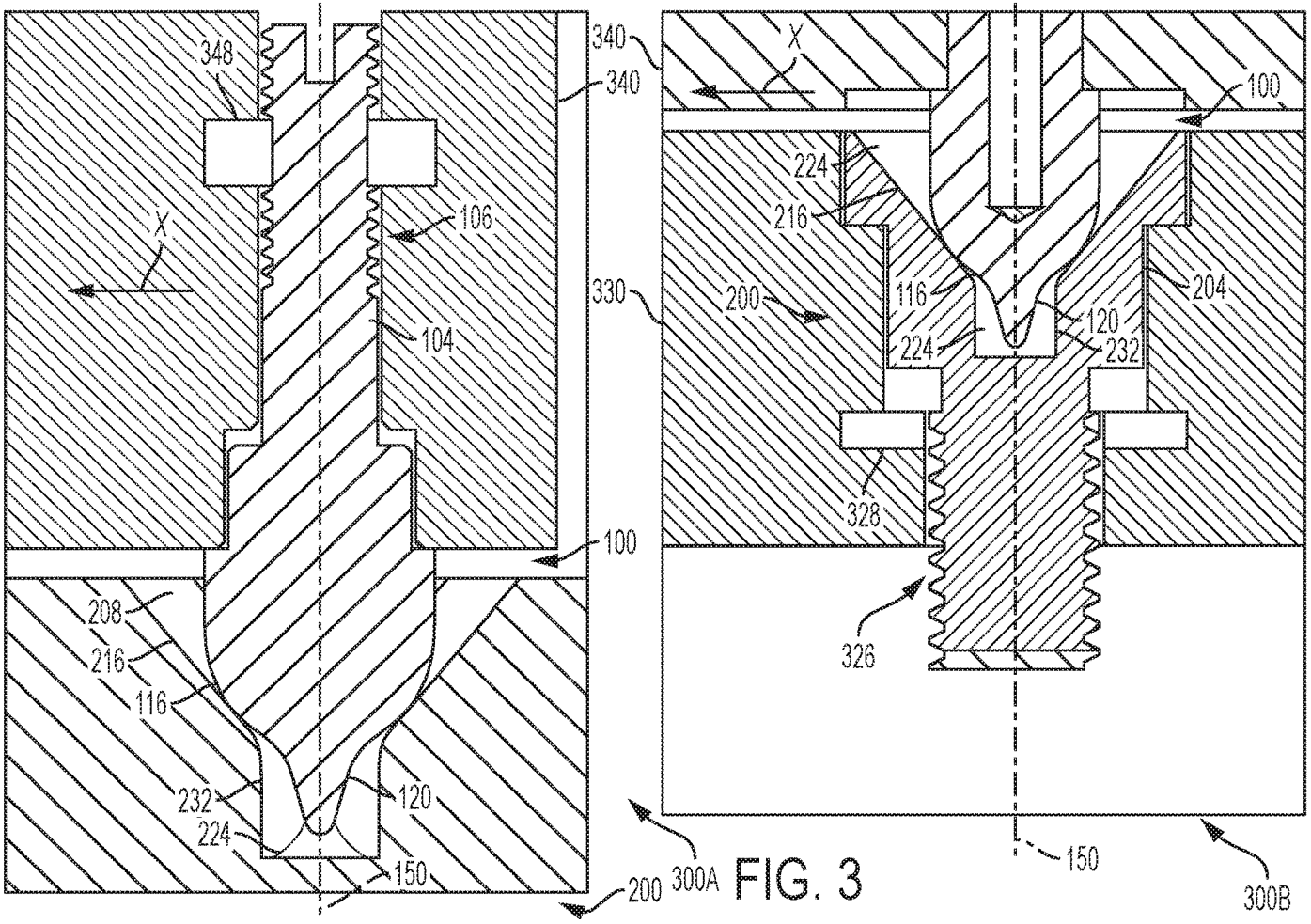
FIG. 3 is a diagram depicting docking devices that include a locating pin and a receptacle.

In an inkjet printer, the receptacle 200 is connected to a frame of the printer at a predetermined location in a print zone, such as at one end of the print bar, to receive the locating pin, such as the locating pin 100 or 500, which is connected to another dockable member in the printer. FIG. 3 depicts two embodiments of docking devices 300A and 300B that both use the locating pin 100 and the receptacle 200. In the embodiments of FIG. 3, the locating pin 100 is engaged or "docked" to the receptacle 200. In FIG. 3, the housing structure 340 that is connected to the locating pin 100 is held at both a predetermined position and at a predetermined angular orientation due to the engagement of the docking devices in the embodiments 300A and 300B. While FIG. 3 depicts the locating pin 100 for illustrative purposes, the locating pin 500 is also suitable for use in the docking device embodiments of FIG. 3.

The embodiment of the docking device 300B includes a receptacle 200 with the same structural elements that are present in the receptacle 200 of docking device 300A including a housing, first cavity formed from at least a first wall with a first opening, second cavity formed from at least a second wall with a second opening that is connected to the first cavity. In the docking device 300B, another shaft with a thread 326 extends from the housing 204 of the receptacle 200 and engages a threaded socket 328 in the frame of the printer. The threaded socket 328 engages the thread 326 on the shaft to hold the receptacle 200 in place and, in some configurations, enables the adjustment of the height of the receptacle 200 along the longitudinal axis 150. While the embodiment 300A depicts the locating pin 100 with an adjustable height and the embodiment of 300B depicts the receptacle 200 with the adjustable height, the docking device optionally includes the features of both embodiments 300A and 300B to enable adjustment to the height of both the locating pin 100 and the receptacle 200 along the longitudinal axis 150. The adjustments to either or both of the locating pin 100 and the receptacle 200 along the longitudinal axis 150 improve the operation of the docking devices 300A and 300B.

In the embodiments 300A and 300B, the locating pin 100 is connected to one end of the housing structure 340 and the receptacle 200 is connected to one end of a print bar 330. The housing structure 340 extends laterally from the locating pin 100 and the print bar 330 extends laterally from the receptacle 200 along the X direction in both of the embodiments 300A and 300B. In FIG. 3, the embodiment 300A depicts the connection between the thread 106 that is formed along shaft 104 and a threaded socket 348 in the housing structure 340. The threaded socket 348 engages the thread 106 to provide a secure connection between the locating pin 100 and the housing structure 340. In some embodiments, the socket 348 also secures the locating pin 100 to the housing structure 340 while enabling rotation of the locating pin 100 to adjust the distance that the locating pin 100 extends from the housing structure 340 along the longitudinal axis 150.

In both of the embodiments 300A and 300B, the receptacle 200 receives the locating pin 100 with at least a portion of the first wall 216 in the first cavity 208 engaging a portion of the partial ellipsoid surface 116 that is formed on the first end 112 of the locating pin 100. The second cavity 224 receives the conical member 120 that extends from the first end 112 of the locating pin 100. In some embodiments, the conical member 120 directly engages the second wall 232 or another wall in the second cavity 224. In other embodiments, the second cavity 224 receives the conical member 120 but the second wall 232 or another wall in the second cavity 224 does not directly engage the conical member 120.

As depicted in FIG. 3, the docking devices in both of the embodiments 300A and 300B secure the print bar 330 and housing structure 340 together in both a fixed location in the print zone and the structure of the locating pin 100 and the receptacle 200 ensures that the locating pin 100 is aligned along the longitudinal axis 150 when docked with the receptacle 200. The alignment of the locating pin 100 along the predetermined longitudinal axis 150 also ensures that the printheads that are affixed to the print bar 330 are positioned with a correct angular orientation relative to the print medium or other image receiving member that is part of the housing structure 340 in the printer.

While FIG. 3 depicts a configuration in which the locating pin 100 is connected to the housing structure 340 and the receptacle 200 is connected to the print bar 330, other configurations reverse this arrangement to connect the locating pin 100 to the print bar 330 and the receptacle 200 to the housing structure 340. While not a requirement, in some configurations the docking device is integrated with two dockable members in the printer with the locating pin 100 or 500 being connected to a first dockable member that moves to dock and undock from the second dockable member. The receptacle 200 is connected to the second dockable member that remains stationary while the first dockable member moves. A print bar and a frame of the printer are a non-limiting example of two dockable members in a printer. Additionally, the locating pin 100 and the receptacle 200 are incorporated into other dockable members in printers that undock and dock from each other in a similar manner to the configuration of FIG. 3.

Figure 4:
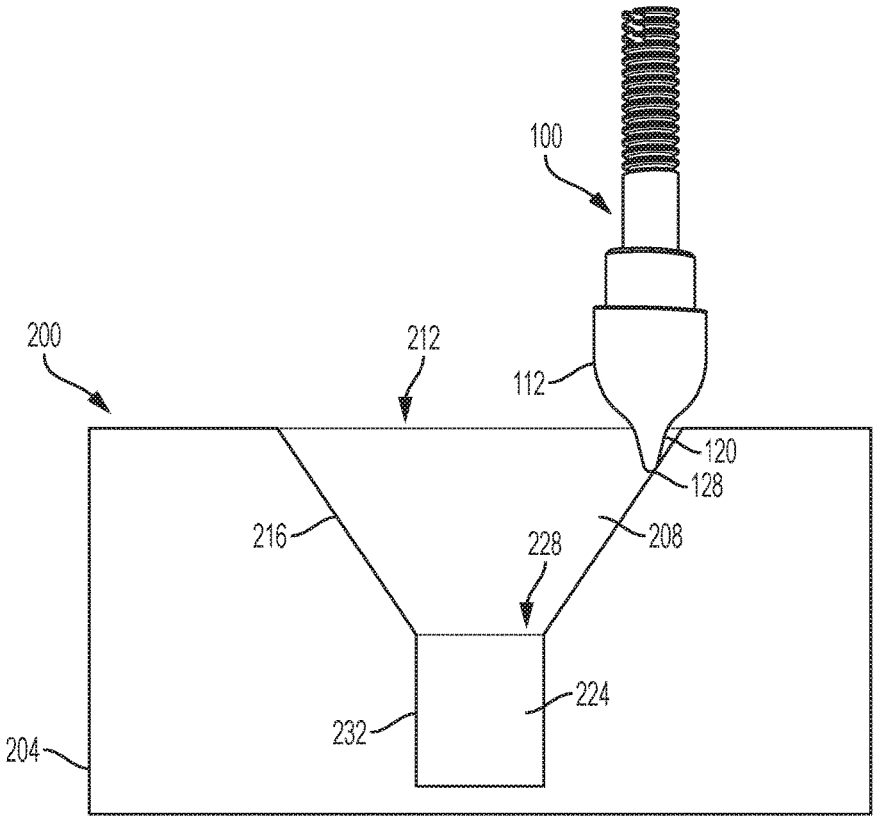
FIG. 4 is a diagram depicting engagement of a locating pin to a receptacle.
Figure 7:
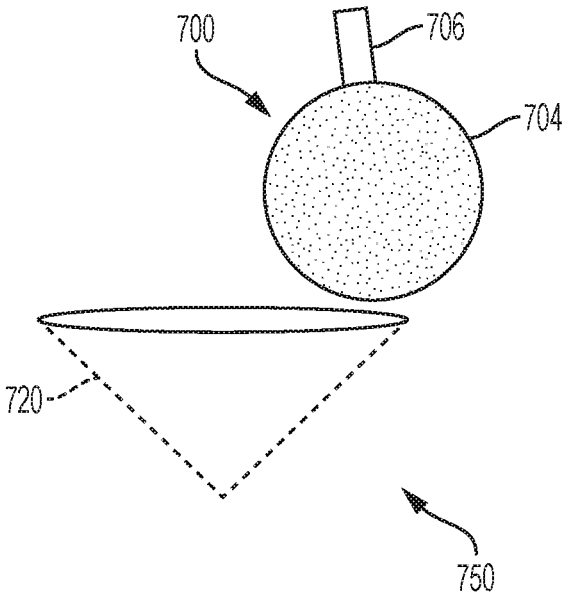
FIG. 7 PRIOR ART
FIG. 7 is a depiction of a prior-art locating pin and bushing.
Figure 7:
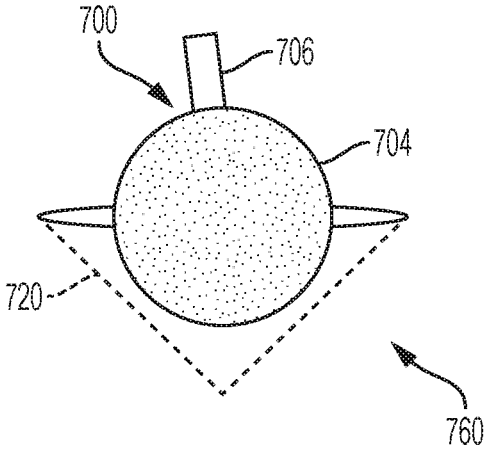
FIG. 7 PRIOR ART

As described above in FIG. 7, one drawback of prior art docking devices is that the prior art locating pins may fail to engage a bushing to dock with the print bar. In the docking device embodiments described herein, however, the structure of the locating pins 100 and 500 improve the ability of the docking device to engage the locating pin to the receptacle. FIG. 4 depicts the locating pin 100 and the receptacle 200 during a docking process as the locating pin 100 approaches the receptacle 200 and prior to completion of the docking as is depicted above in FIG. 3. In FIG. 4, the conical member 120 that extends from the first end of the locating pin 100 engages the first wall 216 in the first cavity 208 of the receptacle 200 even though the first end 112 of the locating pin 100 is not in contact with the receptacle 200. The tip 128 or another portion of the conical member 120 engages the first wall 216 in the first cavity 208. During the docking process, the locating pin 100 remains engaged to the receptacle 200 and slides into the fully docked configuration of FIG. 3.

Figure 6:
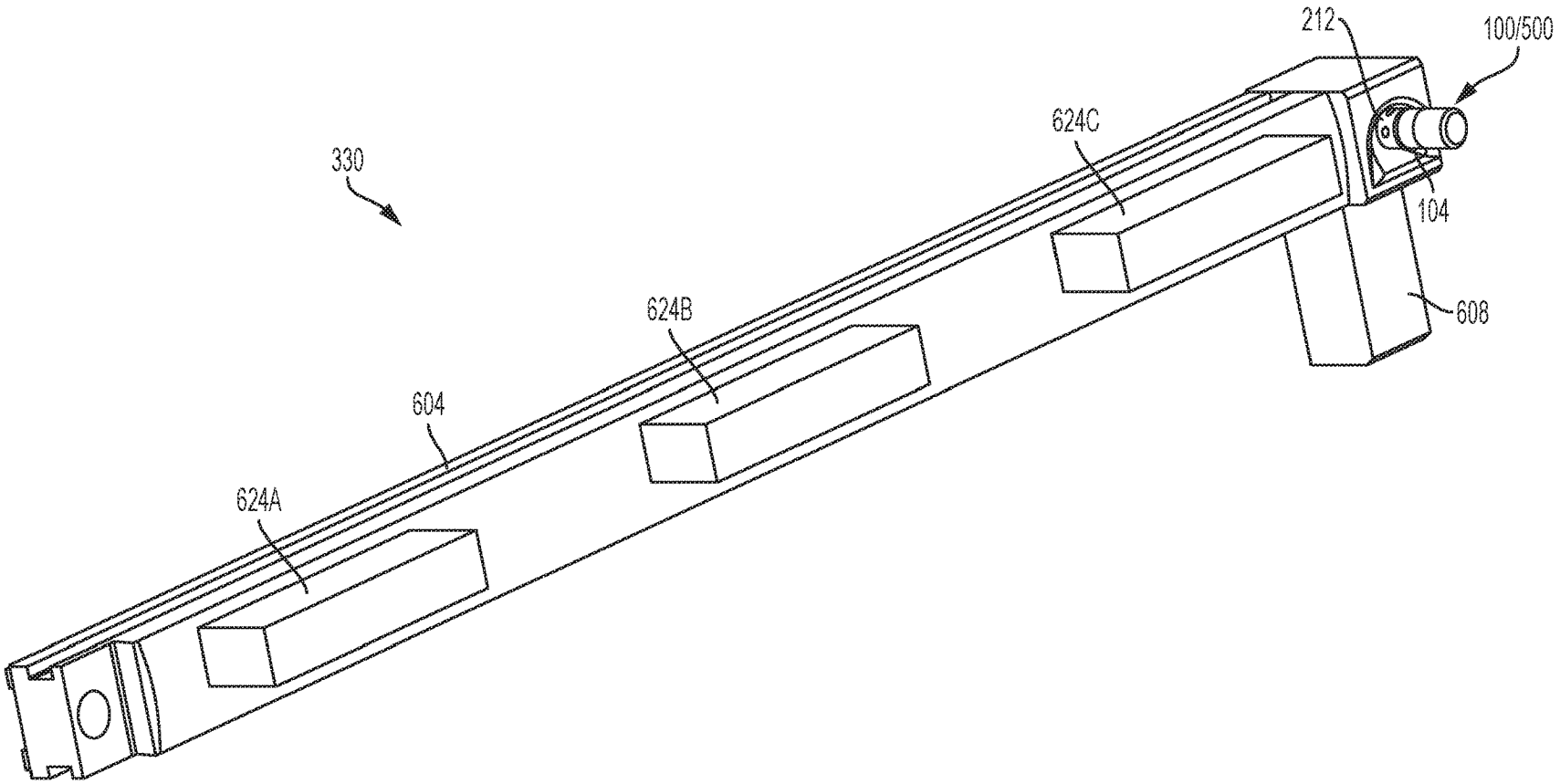
FIG. 6 is a perspective view of a print bar that incorporates the receptacle of FIG. 2 and FIG. 3 and is configured to dock with a housing structure that incorporates the locating pin of FIG. 1 or FIG. 5.

In some configurations, one of the receptacle 200 or the locating pin embodiments 100 or 500 is integrated with a housing structure or print bar in the printer. FIG. 6 depicts an illustrative embodiment of the print bar 330. The print bar 330 includes a lateral support member 604 and an attachment member 608. The lateral support member 604 supports three inkjet printheads 624A-624C in the illustrative embodiment of FIG. 6, although other configurations of the print bar 330 support a different number of printheads. The print bar 330 also includes an attachment member 608 that is affixed to one end of the lateral support member 604. The attachment member 608 is affixed to the frame of the printer to hold the print bar 330 in a fixed position within the print zone of the printer, although in other printer configurations the print bar moves while other dockable members in the printer remain stationary. FIG. 6 depicts one attachment member 608 on one end of the print bar 330 that engages a locating pin, but in other configurations another attachment member is affixed to the other end of the print bar 330 to enable the print bar 330 to dock with the housing structure 340 or another component in the printer at both ends of the print bar 330.

In the embodiment of FIG. 6, the receptacle 200 is incorporated into the attachment member 608, and FIG. 6 depicts the first opening 212 of the first cavity 208 with one of the locating pin embodiments 100 or 500 in a docked configuration with the receptacle and the shaft 104 of the locating pin extending through the first opening 212. FIG. 6 only depicts the shaft 104 of the locating pin for clarity, but in a practical printer embodiment the shaft 104 is connected to the housing structure 340 or another dockable member in the printer. As described above, the docking device with the locating pin 100 or 500 and the receptacle 200 enables the print bar 330 and the housing structure 340 to dock and undock in a repeatable manner that returns the printheads 624A-624C to a predetermined position in a print zone to enable printing on a print medium or other image receiving surface.

It will be appreciated that variants of the above-disclosed and other features and functions, or alternatives thereof, may be desirably combined into many other different systems, applications or methods. Various presently unforeseen or unanticipated alternatives, modifications, variations or improvements may be subsequently made by those skilled in the art that are also intended to be encompassed by the following claims.

What is claimed:

1. A locating pin for a dockable member in a printer comprising:

a shaft including a first end having a surface forming a partial ellipsoid and a second end, the shaft being configured to engage the dockable member along a portion of the shaft between the second end and the first end; and a conical member with a base aligned with the surface of the first end and a tip extending from the surface of the first end, the shaft and the first end of the shaft are formed as a first member and the conical member is formed as a second member, the second member being configured for selective coupling to the first member.

2. The locating pin of claim 1 further comprising:

a thread formed along the portion of the shaft extending from the second end to enable the shaft to engage a socket in the dockable member.

3. The locating pin of claim 1, wherein the shaft and the conical member are oriented along a single longitudinal axis.

4. The locating pin of claim 1, wherein the shaft, the first end, and the conical member are formed from a monolithic member.

5. The locating pin of claim 4, wherein the monolithic member substantially comprises stainless steel.

6. The locating pin of claim 1, wherein the first member substantially comprises stainless steel and the second member at least partially comprises rubber.

7. The locating pin of claim 1, wherein the base of the conical member conforms to the partial ellipsoid of the first end.

8. The locating pin of claim 1 wherein the surface of the first end forms a partial spheroid.

9. A docking device for dockable members in a printer comprising:

a locating pin, the locating pin comprising:

a shaft including a first end having a surface forming a partial ellipsoid and a second end, the shaft being configured to engage a first dockable member along a portion of the shaft between the second end and the first end; and a conical member with a base aligned with the surface of the first end and a tip extending from the surface of the first end; and a receptacle configured to be integrated with a second dockable member, the receptacle comprising:

a housing comprising:

a first cavity formed at least partially from a first wall in the housing and including a first opening, the first cavity being configured to receive the first end and the conical member of the locating pin; and a second cavity formed at least partially from a second wall in the housing, the second cavity including a second opening in communication with the first cavity, the second opening being narrower than the first opening, the second cavity being configured to receive the conical member of the locating pin.

10. The docking device of claim 9, the locating pin further comprising:

a thread formed along the portion of the shaft extending from the second end to enable the shaft to engage a socket in the first dockable member.

11. The docking device of claim 9, wherein the shaft and the conical member of the locating pin are oriented along a single longitudinal axis.

12. The docking device of claim 9, wherein the base of the conical member in the locating pin conforms to the partial ellipsoid of the first end.

13. The docking device of claim 9, wherein the shaft, the first end, and the conical member in the locating pin are formed from a monolithic member.

14. The docking device of claim 13, wherein the monolithic member substantially comprises stainless steel.

15. The docking device of claim 9, wherein the shaft and the first end are formed as a first member and the conical member is formed as a second member, the second member being configured for selective coupling to the first member.

16. The docking device of claim 15, wherein the first member substantially comprises stainless steel and the second member at least partially comprises rubber.

17. The docking device of claim 9, wherein the surface of the first end in the locating pin forms a partial spheroid.

18. The docking device of claim 9, wherein the first wall of the first cavity tapers from the first opening to meet the second wall of the second cavity at the second opening.

19. The docking device of claim 9, wherein the first wall and the second wall of the housing substantially comprise stainless steel.

20. The docking device of claim 9, wherein the receptacle is incorporated into a print bar in the printer.

21. The docking device of claim 9, wherein the locating pin is incorporated into a print media unit in the printer.

22. The docking device of claim 9, wherein the locating pin is incorporated into a printhead maintenance unit in the printer.

* * * * *